United States Patent [19]

Walker, Jr.

[11] 3,974,593

[45] Aug. 17, 1976

[54] FIGURE WITH MOVABLE LIMBS, AND BASE FOR MOUNTING SAME

[76] Inventor: Wilmer David Walker, Jr., 1316 Sharon St., N.W., Atlanta, Ga. 30314

[22] Filed: Apr. 3, 1975

[21] Appl. No.: 564,827

[52] U.S. Cl. ..... 46/22; 35/28

[51] Int. Cl.[2] ..... A63H 3/16

[58] Field of Search ..... 46/22, 16, 17, 161; 35/28, 29 D

[56] References Cited

UNITED STATES PATENTS

| | | | |
|---|---|---|---|
| 1,423,618 | 7/1922 | Lacey | 46/22 |
| 2,118,093 | 5/1938 | McCue | 35/28 |
| 2,327,718 | 8/1943 | Kassler | 35/28 |
| 3,090,157 | 5/1963 | Lohr | 46/161 X |
| 3,210,884 | 10/1965 | Sharff et al. | 46/22 |

FOREIGN PATENTS OR APPLICATIONS

| | | | |
|---|---|---|---|
| 544,867 | 1956 | Belgium | 46/17 |

OTHER PUBLICATIONS

Barry Taycraft Catalog, published for year 1965.

*Primary Examiner*—F. Barry Shay
*Attorney, Agent, or Firm*—Jones, Thomas & Askew

[57] ABSTRACT

An educational construction toy comprising a base member shaped like the body of an object and including a plurality of appendages selectively fixable to the base member, the appendages being selectable to vary characteristics of the object, the object being preferably a human form.

6 Claims, 8 Drawing Figures

FIGURE WITH MOVABLE LIMBS, AND BASE FOR MOUNTING SAME

This invention relates to constructional toys, and is more particularly concerned with an educational toy for teaching the constructional relationship of parts.

It is well known that the first thing to which a child pays attention is his own body, and there is a consuming interest in the overall construction and make-up of the child's body. As the child matures, it is necessary that the child learn the construction of its body and the function of its body in order to learn to use its body to manipulate other things and to master skills such as acrobatics, dancing and various sports, as well as construction projects that require a good prehensile ability.

It is also well known that a child has a great interest in the differences between himself and other children, and that a child tends to investigate these differences in an effort to understand both the physical differences and the composition of the differences. For instance, a child tends to notice differences in sex, skin color, manner of dress, hair color and styles and the like: things that cause different persons to look different, and differences by which people are normally categorized by sex, national origin and the like. A child, then tends to consider the differences, and must be taught to recognize the similarities in order to gain an understanding of the human body and understand its construction and its function.

In the past, there have been numerous constructional toys involving the bodies of various animals, including the human body; however, such prior art toys have not recogized the need for a child to learn the logical parts of a body, but tend to treat the body instead in jigsaw-Puzzle fashion, rending the body into numerous random pieces for a child to put together on the basis of the shapes of pieces, or edges, rather than on the basis of the proper location of the logical aspect of the body. Such prior art toys may assist a child in learning the overall appearance of the body, and even assist in development of a child's prehensile ability, but such toys do not teach a child the significance of physical differences in people and allow a child to understand the effect of each individual difference. Rather, the prior art toys tend to direct a child's attention away from physical construction of a body and towards the manipulative skill of putting matching pieces together.

The apparatus of the present invention overcomes the above-mentioned and other difficulties with prior art constructional toys by providing a separable articulated figure wherein the articulated joints correspond to the articulated joints on the live counterpart, and the separate pieces of the toy correspond to the normally learned parts of the live counterpart. Furthermore, the separate parts of the toy made in accordance with the present invention are interchangeable so a child can construct a figure with the desired characteristics to alter sex, occupation, hair color and any other features desired. In one embodiment of the invention, the facial features can be changed individually to change expression of a face as well as simply the personal physiognomy of the face. A child can therefore manipulate the toy of the present invention to see the result of various individual changes in physical structure of a figure, and the child will learn the usual parts of the body in so doing. In the process, the child will develop its prehensile ability due to necessary manipulation of the various pieces of the toy, and the joining together of various pieces.

These and other features and advantages of the present invention will become apparent from consideration of the following specification when taken in conjunction with the accompanying drawings in which.

Figure 4:
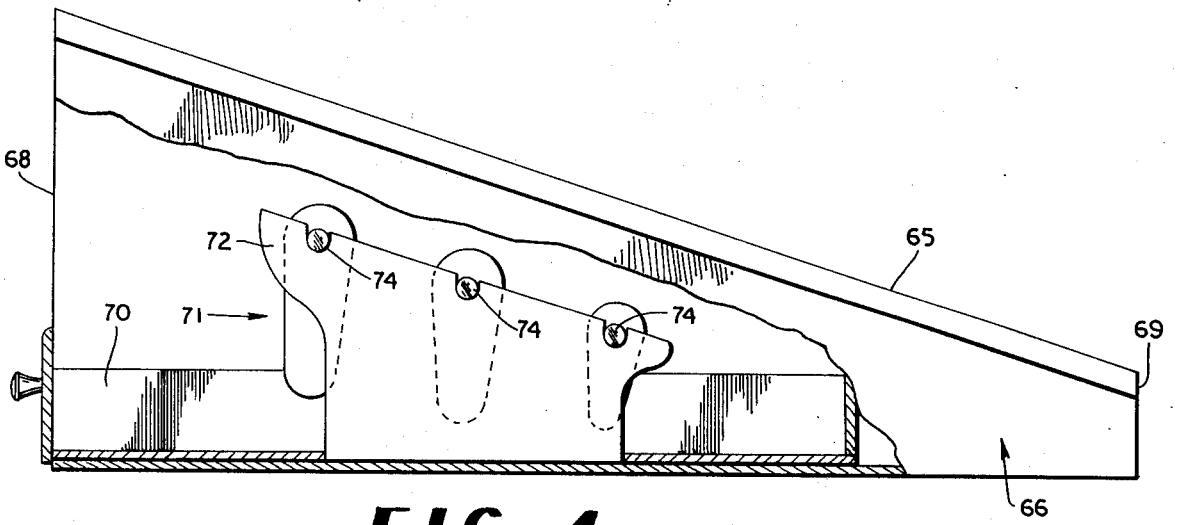
FIG. 4 is a side elevational view, partially in cross-section, showing another embodiment of the present invention.
Figure 6:
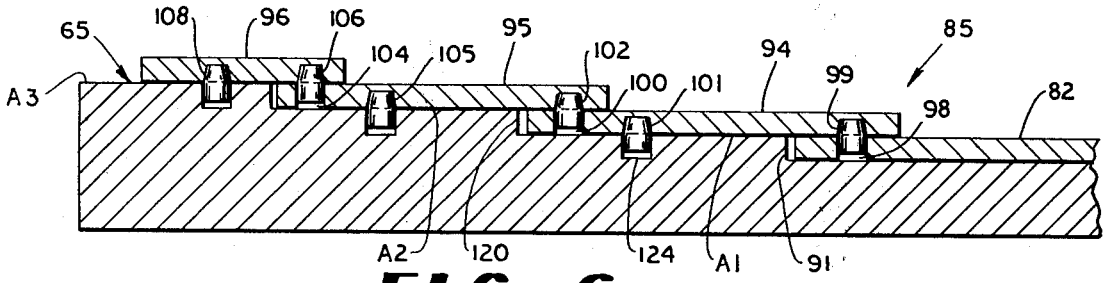
Figure 7:
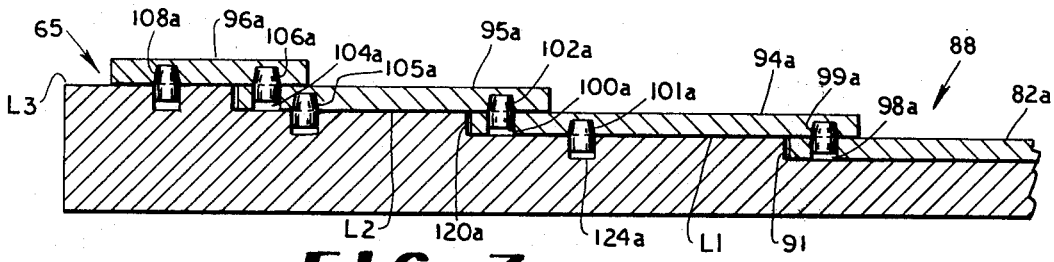
Figure 8:
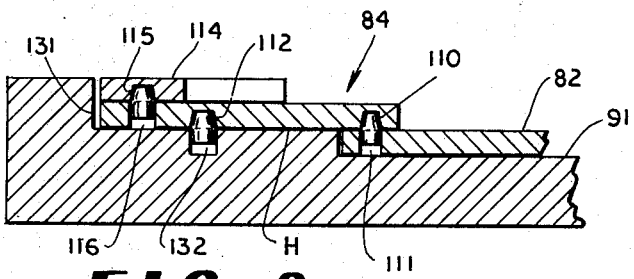
Figure 5:
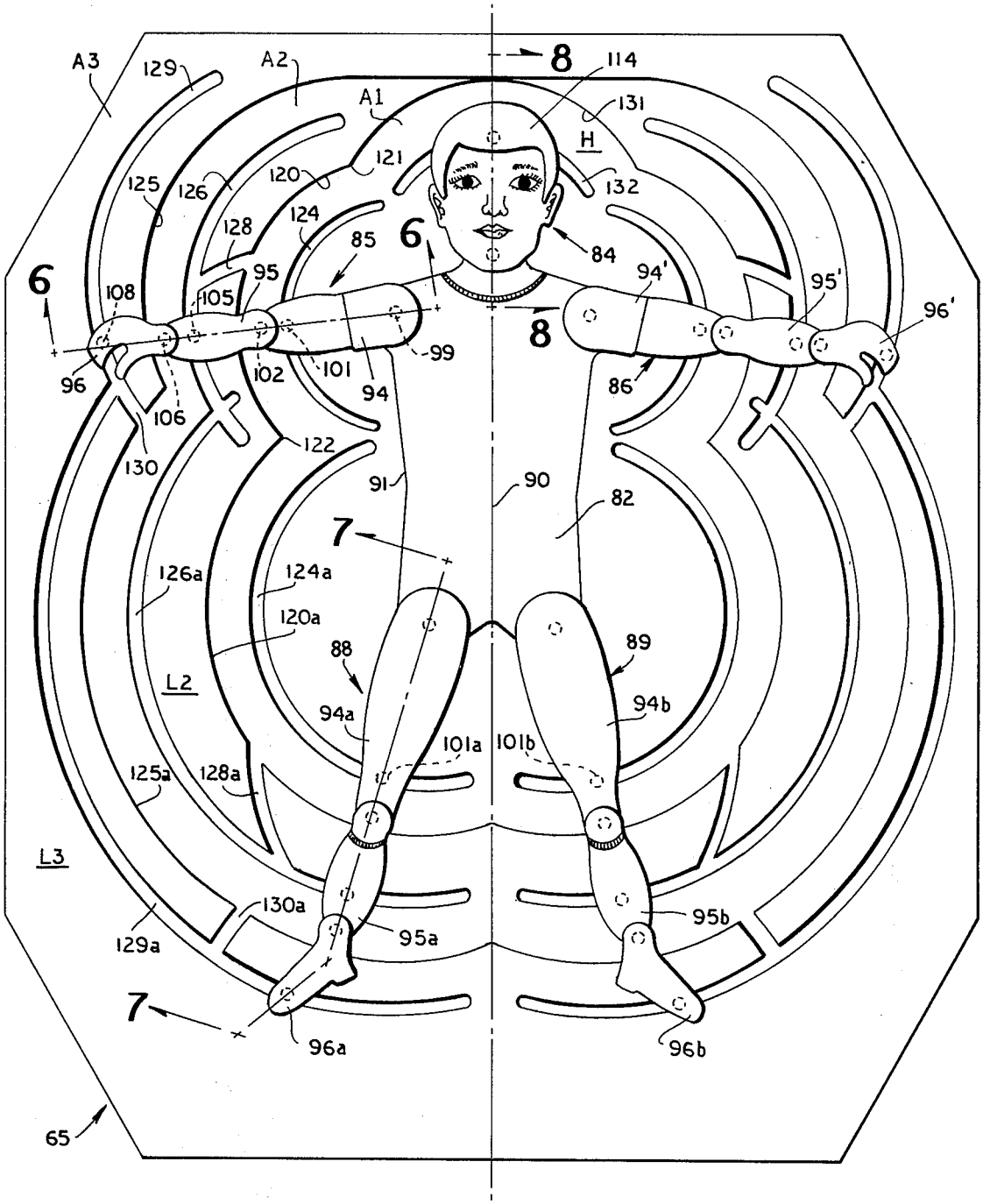

FIG. 5 is a plan view of the construction board in the embodiment of the invention showing in FIG. 4 with a figure constructed on the construction board; and, FIGS. 6, 7 and 8 are cross-sectional views taken substantially along the lines 6—6, 7—7 and 8—8 respectively in FIG. 5.

Referring now more particularly to the drawings, and to those embodiments of the invention here chosen by way of illustration, it should first be understood that the concept of the present invention includes a separable body wherein the separable parts are logically discrete parts. The parts are so constructed that a child playing with the toy must make a decision as to the proper location of a part on the basis of the part itself rather than on the basis of the shape of interlocking edges or the like. Due to this arrangement, a child tends to learn to identify a particular part as such, and to learn where that part is located with respect to the whole body.

Furthermore, the particular embodiments of the invention here presented can be considered as graded by age of the child for whom they are intended, the grading being on the basis of a child's knowledge of the body, the prehensile ability of the child, and the interest of the child in particular types of toys.

Figure 1:
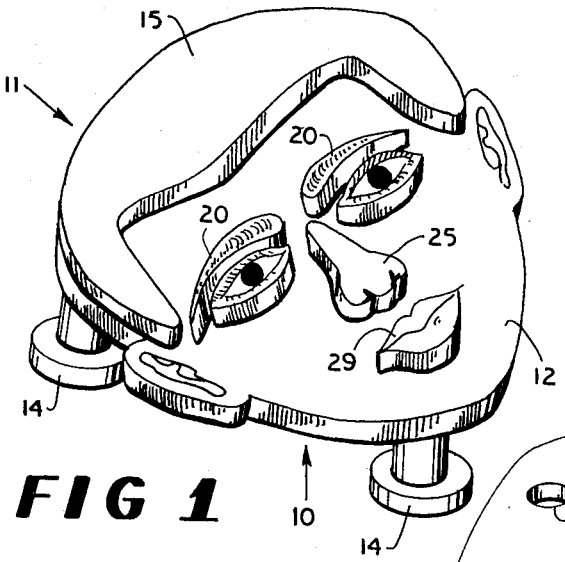
FIG. 1 is a perspective view of one embodiment of the present invention, fully assembled.
Figure 2:
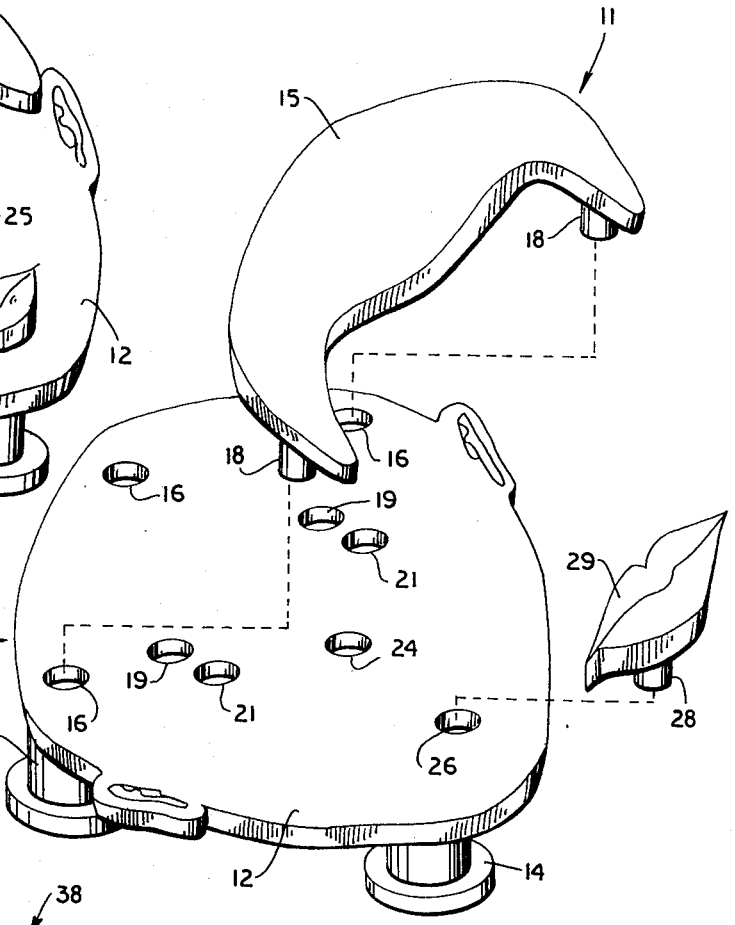
FIG. 2 is an exploded perspective view of the toy shown in FIG. 1, but with parts omitted.

With the above in mind, attention is directed to FIGS. 1 and 2 of the drawings which show a body 10 having a plurality of separable parts generally designated at 11. The body 10 as illustrated is in the form of a human head, though it will be understood that other shapes could be equally well used. The body 10 includes a base member 12 that is supported by a plurality of legs 14.

As best indicated in FIG. 2, the base member 12 has a shape corresponding to a human head in front elevational view. This general shape does not in itself, require that the final figure to be formed be any particular sex, race or the like, but allows the final figure to be determined by selection of the other characteristics. The other characteristics 11 are appendages to the base member 12, the appendages in the embodiment of FIGS. 1 and 2 being in the form of the various parts of a human face. In more detail, the appendages include hair 15 of a size to fit over the upper portion of the base member 12. The hair 15 can be designed to fit any style desired and can be, by way of example, a style indicating a boy or a girl, and can be a conservative style perhaps to indicate an older person, or a modern liberal style to indicate a younger person. It is contemplated that there would be available to a child a number of different hair styles 15 from which a child can choose any style he wishes.

To fix the hair 15 in place on the base member 12, the base member 12 has a plurality of holes 16; and, complementary to the holes 16, the hair 15 has plurality of pegs 18 extending therefrom. Thus, a child must recognize the hair and determine its proper place on the base member 12, then the pegs 18 can be inserted into the holes 16.

Other parts of the device are similarly constructed and are selected and placed on the base member 12 in the same manner. The base member 12 has a pair of holes 19 to receive appropriate pegs on eye brows 20; there is a pair of holes 21 to receive pegs on the eyes 22; there is a hole 24 to receive a peg for the nose 25; and, there is a hole 26 to receive the peg 28 on the mouth 29.

Thus, each individual piece of the whole can be removed and replaced by similar piece having a different design. Through appropriate changing of the various appendages 11, a child can learn precisely which aspects of a face cause a face to have a particular appearance, whether boy or girl, happy or sad, Scandinavian or South African. The appendages are so designed that a small child with relatively undeveloped prehensile ability can manipulate the pieces, so the child will improve his manipulative skills while learning more about the face.

Figure 3:
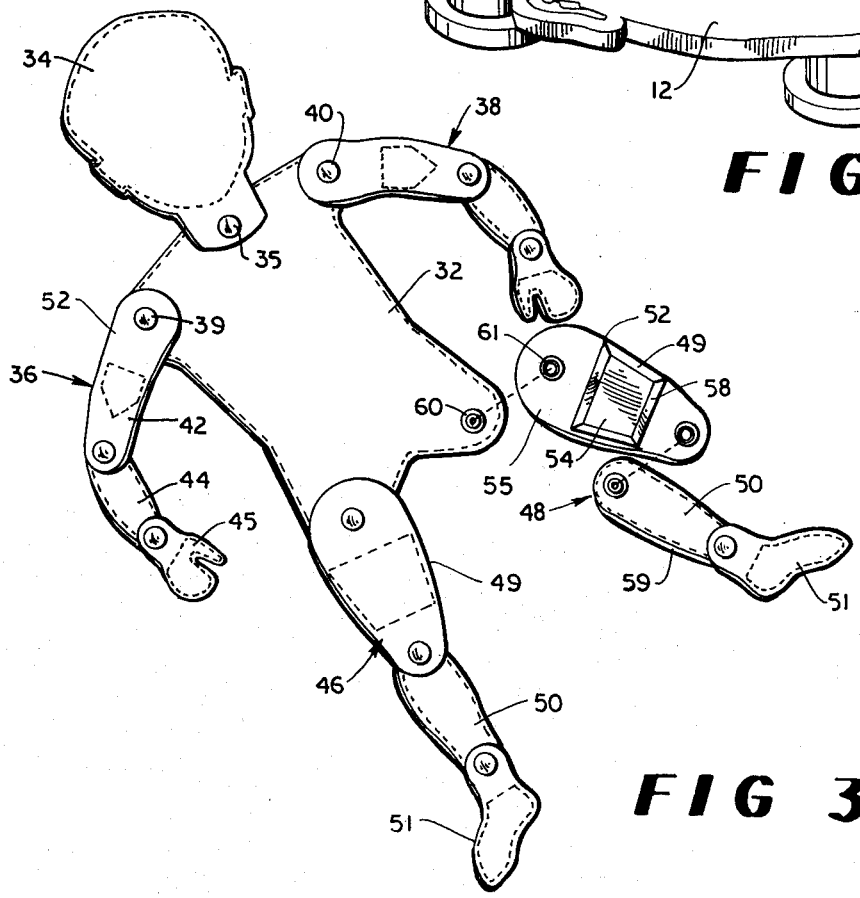
FIG. 3 is a perspective view of another embodiment of the present invention, one separable piece being removed to show the construction.

The next embodiment of the present invention is shown in FIG. 3 of the drawings. This embodiment, as illustrated, includes the entire human body and would appeal to a somewhat older child than would the previously described embodiment.

The device shown in FIG. 3 includes a base member 32 which is shaped to resemble the human torso. The appendages are then attached to this base member 32, and the appendages comprise the various parts of the body as normally learned by children. It will be seen that the head 34 is fixable to the torso 32 by fastener 35 and, each of the arms 36 and 38 is fixable to the base member 32 by fasteners 39 and 40; and each of the arms 36 and 38 is made up of separable segments resembling the upper arm 42, the lower arm 44, and the hand 45. Legs 46 and 48 are similarly provided, and the legs include the upper leg, or thigh 49, the lower leg 50 and the foot 51.

The device shown in FIG. 3 is constructed of a substantially flexible sheet material with substantially inflexible partitions between the points of articulation. With this construction, the flexible sheet material 52 provides the complete surface of the figure as completely put together and can be textured to add the extra tactile dimension of the toy. Additionally, the material 52 spans each point of articulation so that the appendages are movable in two planes with respect to the base member 32.

The separable piece 49 of the appendage 48 is removed in FIG. 3 to show the construction. Here it will be seen that there is a rigid or inflexible backing 54 having generally the shape of the part 49 of the appendage. The flexible skin 55 is fixed to the backing 54 and is shaped to form the entire portion 49. It will be seen that one edge 58 of the backing 54 is mitred. This allows the backing 54 to work complementarily with the backing 59 on the portion 50 to allow bending of the area of articulation. Such an arrangement can be used at any of the point of articulation as desired.

The fastening means to render the appendage fixable to the base member 32 are here shown as conventional snap fasteners. By way of illustration a male member 60 is fixed to the base member 32 in a location approximately the left hip joint of the figure. The female member 61 is mounted in the flexible skin 55 of the portion 49 so the two pieces can be snapped together. However, it should be realized that all the snaps are substantially identical so that any of the appendages could be fixed to the male member 60. As a result, a child must learn to recognize the part and know where that part ought to be located before the child can properly assemble the figure. Once the figure is assembled, it will be seen that each of the articulated areas is such that the appendage will rotate about the center point of the fastener, and the appendage will move through flexing of the flexible material.

The apparatus shown in FIGS. 4—8 is somewhat more elaborate than the previously described embodiments of the invention and includes a construction board 65 carried on a container 66. The container 66 is slanted, with the rear wall 68 higher than the front wall 69 so work on the construction board 65 is convenient. The container 66 includes a removable drawer 70 which contains all parts and accessories for this embodiment of the invention. Some of the pieces are of elongate form, and are held on a rack 71 that is formed of a pair of upstanding members 72 having a plurality of rods 74 extending between the members 72 to carry these elongated pieces. These pieces will be discussed in detail hereinafter and reference will be made to their storage when not in use. It should be noticed that the drawer 70 is completely removable from the container 66 so that, when the apparatus is in use the drawer 70 can be removed and placed beside the construction board 65 so all parts and accessories will be readily available for the desired construction.

Attention is now directed to FIG. 5 of the drawings which shows the face of the construction board with a figure constructed on the board 65.

It should first be realized that the embodiment of the invention here presented is for older children and is thus somewhat more complex to hold the attention of the older children. Though the present embodiment includes a base member 82 comparable to the base member 12 and the base member 32, the base member 82 is interchangeable with other like members to make changes in the total figure as will be discussed more fully hereinafter. The additional base members would be stored in the drawer 70 to be available for the desired construction.

The figure shown in FIG. 5 includes the base member 82 which is shaped like the torso of a person. There are then a plurality of separable appendages that can be appropriately fixed to the base member 82, the appendages including, in general, a head 84, two arms 85 and 86 and two legs 88 and 89. As will be better understood later, each of the appendages is separably fixed to the base member 82 through the receipt of a peg in one piece with a hole in another piece. Again, the locking arrangement allows pivoting of the various pieces with respect to one another to simulate the natural motion of a human body. Also, the hole in each piece allows passage of a rod 74 therethrough so the pieces can be hung on the rack 71.

The base member 82, as previously stated, is shaped like a human torso. To provide variety in construction of figures, it will be understood that a base member 82 will be painted, printed or otherwise decorated to indicate clothing and/or other features of the physiognomy. The base member 82 is symmetrical about the centerline 90 so that both the back and the front of the base member 82 can be differently decorated; thus, each separate base member 82 can provide two different costumes or the like.

The base member 82 is receivable within a recess 91 in the construction board 65 so that the base member 82 is located in a fixed relationship with respect to the construction board 65. The bottom of the recess 91 is on a horizontal level that will be referred to as the first level, and when the base member 82 is placed within the recess 91, the upper surface of the base member 82 will be on the second level.

Considering first among the appendages the arm 85, it will be seen that the arm 85 comprises a group of pieces that, again, correspond to the logical division learned by most people, i.e. an upper arm 94, a lower arm 95, and a hand 96. It will be seen that the base member 82 includes a hole therethrough in a location corresponding to the shoulder on the torso, this hole being designated 98. The upper arm 94 has a peg 99 at the proximal end thereof, the peg 99 being receivable within the hole 98. This construction is shown in FIG. 6 of the drawings.

The upper arm 94 extends outwardly from the base member, or torso, 82 and is on the second level. The upper surface of the upper arm 94 is on what will be referred to as a third level. At the distal end of the upper arm 94 there is a hole 100 for receipt of the next piece; and, between the proximal end and the distal end there is a guide pin 101 that extends down towards the construction board 65.

The lower arm 95 is similarly formed, having a peg 102 to be inserted into the hole 100 of the upper arm 94, a hole 104 in the distal end, and a guide pin 105 between the proximal end and the distal end. Since the lower arm 95 lies on the upper surface of the upper arm 94, it will be understood that the lower arm rests on the third level and its upper surface is on a fourth level.

Following the same course, the hand 96 has a peg 106 at its proximal end for inserting into the hole 104 of the lower arm. The distal end of the hand, being the outermost end of the appendage, does not have a locking means; however, there is a guide pin 108 between the proximal end and the distal end.

It will now be seen that the appendage 85 has a fastening means for fastening the appendage 85 to the base member 82, the fastening means comprising the peg 99 and the hole 98 for receiving the peg 99 so that a pivotal fastening arrangement is provided. The appendage 85 is separable into parts, and each part is fastenable to the previous part with a pivotal fastening means. The opposite arm 86 is constructed in the same way, so no separate discussion should be necessary, and primes of the same numerals are applied to parts thereof.

The appendage 88 is also similarly constructed. Since the appendage 88 is in the form of a leg, it includes a thigh 94*a*, a lower leg 95*a* and a foot 96*a*. Other parts carry the same numerals as the appendage 85, but with an *a* suffix; and, the appendage 89 similarly carried the same numerals but with a *b* suffix.

The next appendage is the head 84. The head has a peg 110 located at its proximal end; and, a hole 111 is provided in the base member 82 in the area formed as the neck. The peg 110 is receivable within the hole 111 to provide a fastening means as previously described. Also, outwardly of the peg 110 there is a guide pin 112.

The head 84 of the present embodiment partakes of the design of the first-described embodiment in that features on the head are interchangeable. As here shown, only one feature is interchangeable; but, it will be understood that the entire arrangement substantially as shown in FIGS. 1 and 2 could be used if desired. The one feature that is interchangeable in this embodiment is the hair 114, and this is accomplished in precisely the same manner as the embodiment shown in FIGS. 1 and 2 including a plurality of pegs 115 receivable within holes 116. No further discription is deemed necessary.

Having in mind the construction of the figure, attention is directed to the construction board 65 as best seen in FIG. 5 of the drawings. In general, the construction board 65 includes the area 91 for receiving the base member 82, and an area for receiving each of the appendages, the area for each of the appendages including a guide slot for receiving the guide pins described above. Each of the areas is sufficiently defined to constrain a child to place the proper type of piece in each area.

Considering the construction board 64 in more detail, the recess 91 is the area for the torso, or the base member 82. The base member 82, it will be remembered, has a plurality of holes, such as the hole 98, which act as the female member of the fastening means; and, appendages are pivotally fixed to each of the fastening means. This leads to a plurality of areas formed generally as sectors having the holes 98 et seq. as the center of the sectors. Thus, the hole 98 is the center for area A1 which is defined by a vertical wall 120. The wall 120 terminates in a pair of cusps 121 and 122 at each end thereof.

As previously mentioned, the area 91 is on a first level. The area A1, then is on the second level; however, there is a guide slot 124 concentric with the wall 120, the bottom of the slot 124 extending down to the first level. As a result, when a piece 94 is placed on the area A1, the guide pin 101 will extend into the guide slot 124, and the distal end of the piece 94 will be adjacent to the wall 120. with the peg 99 within a hole 98, the piece 94 can move across the area A1, limited in each direction by the extremes of the guide slot 124.

The next area A2 is on the third level, and is defined by the wall 120 at one side and a wall 125 outwardly of and concentric with the wall 120. The area A2 includes a guide slot 126 similar to the slot 124 so that, when the piece 95 is placed on the area A2, the guide pin 105 will be received within the slot 126. The distal end of the piece 95 will be adjacent to the wall 125 when the piece 95 is in a straight line from the piece 94; however, it will be noticed that there is a branch 128 to the guide slot 126. Due to the presence of this branch 128, the guide pin 105 can be moved through the branch 128 and into the area A1, the only limits to movement of the piece 95 are the wall 120 and the piece 94.

The area A3 is the area on the fourth level adjacent to the area A2 and is bounded by only the wall 125 and the outer edge of the construction board 65. The area A3 includes a guide slot 129 for receiving the guide pin 108 on the piece 96. The slot 129 includes a passageway 130 so that the guide pin 108 can pass through the passageway 130 and into the area A2 where the piece 96 will be freely movable.

The area L1 is similar to the area A1 except that the area L1 has its center at the hole 98*a*. The area L1 is bounded by a wall 120*a* and includes a guide slot 124*a*. All other aspects of the areas L1, L2 and L3 are similar to the areas A1, A2 and A3 and have the same numerals applied thereto with an *a* suffix.

The entire construction board 65 is symmetrical about the vertical centerline, so the comparable areas on the opposite side of the centerline 90 will not be separately described, it being understood that all parts will be mirror images of the parts hereinabove described.

The only remaining area of the construction board 65 is the area H which is a sector having its center at the hole 111. The periphery of the sector is defined by a wall 131, and the area contains a guide slot 132. It will be understood that the head 84 lies in the area H and is movable pivotally about the hole 111 as limited by the guide pin 112 within the guide slot 132.

From the foregoing, it should now be understood that the third embodiment of the invention provides a construction board that places certain constraints on a child playing with the toy, but these constaints relate only to the basic form of movement of the figure to be created by the child. Presumably there would be a great variety of pieces available to a child so that the child could create a figure having a great variety of characteristics. Different heads can be provided having general characteristics; and selection of a particular kind of hair can then make the head into male, female, oriental, occidental or the like.

It is contemplated that the appendages 85–89 will be available to the child with a variety of costumes painted, printed or otherwise indicated thereon, and a torso 82 would also be available to complete the ensemble. Therefore, a child can create whatever character the child desires, and can manipulate the character by moving the appendages through the areas designated.

It will of course be understood by those skilled in the art that the particular embodiments of the invention here presented are by way of illustration only, and are meant to be in no way restrictive; therefore, numerous changes and modifications may be made and the full use of equivalents resorted to without departing from the spirit or scope of the invention as defined by the appended claims.

I claim:

1. A construction toy for selectively forming a figure having a central body, said toy comprising a base member representing said central body, a plurality of locations on said base member, a plurality of appendages selectively separably fixable to each of said plurality of locations, a plurality of fastening means for selectively separably fixing said appendages to said base member, each said fastening means including a first element and a second element, said first element being fixed at one of said plurality of locations, the other of said elements being fixed to one of said appendages, at least some of said appendages including a plurality of parts, and fastening means for selectively separably fixing each of said plurality of parts to another of said parts and to said base member, each of said fastening means including a male member and a female member, said male member being rotatable with respect to said female member, and including means for supporting said figure, said supporting means and said appendages including coacting guide means for constraining the motion of each of said appendages, and including a first level for receiving said base member, and a second level higher than said first level for receiving one of said parts of said appendages, a first guide means comprising a groove in said second level, and a pin extending from said part into said groove.

2. A toy as claimed in claim 1, and including a third level higher than said second level for receiving a second one of said parts of said appendages, and said second one of said parts being fastened to said one of said parts by one of said fastening means, a second of said guide means comprising a groove in said third level, and a pin extending from said second one of said parts into said groove, said groove of said second guide means being concentric with said groove of said first guide means.

3. A toy as claimed in claim 2, and including a fourth level higher than said third level for receiving a third one of said parts of said appendages said third one of said parts being fastened to said second one of said parts by one of said fastening means, a third of said guide means comprising a groove in said fourth level and a pin extending from said third one of said parts into said groove, said groove of said third guide means being concentric with said groove of said second guide means.

4. A toy as claimed in claim 2, said groove of said second guide means including a passageway extending from said groove to said second level.

5. A toy as claimed in claim 3, said groove of said third guide means including a passageway extending from said groove to said third level.

6. A toy as claimed in claim 5, said toy comprising a container for receiving said base member and said appendages, said supporting means including a construction board fixed to said container, said construction board defining a recess therein shaped to receive said base member and being on said first level, said base member having a plurality of apertures therethrough, each of said plurality of apertures constituting said female member of said fastening means, each of said plurality of apertures constituting the center of said concentric grooves of said guide means.

* * * * *